US005113760A

United States Patent [19]

Sonobe et al.

[11] Patent Number: 5,113,760

[45] Date of Patent: May 19, 1992

[54] INK ROLLER FOR PRINTING MACHINE

[75] Inventors: Saburo Sonobe, Toride; Nobuyuki Ishibashi, Matsudo, both of Japan

[73] Assignee: Kinyosha Co., Ltd., Tokyo, Japan

[21] Appl. No.: 313,966

[22] PCT Filed: Dec. 21, 1987

[86] PCT No.: PCT/JP87/01001

§ 371 Date: Jan. 31, 1989

§ 102(e) Date: Jan. 31, 1989

[87] PCT Pub. No.: WO89/05732

PCT Pub. Date: Jun. 29, 1989

[51] Int. Cl.[5] ..... B41F 31/26; B41L 27/12

[52] U.S. Cl. ..... 101/348

[58] Field of Search ..... 101/348, 349, 216; 427/423; 29/132, 121.1

[56] References Cited

U.S. PATENT DOCUMENTS 4,438,063 3/1984 Suguri et al. ..... 264/311

FOREIGN PATENT DOCUMENTS 6430272 8/1962 Japan .
1-112971 1/1963 Japan .
14997 1/1986 Japan .
62-71649 4/1987 Japan .

OTHER PUBLICATIONS

"Silica Spherical Micro Powder Alumina Spherical Micro Powder", Micron Co. Ltd., Nippon Steel Group, 1, Fuji-cho, Hirohata-ku, Hime Ji City, Japan.

"Spherical Alumina Alunabeads CB", Sales Technical Bulletin, Showa Denko K.K., Minatoku, Tokyo 105, Japan.

*Primary Examiner*—J. Reed Fisher

*Attorney, Agent, or Firm*—Nixon & Vanderhye

[57] ABSTRACT

According to a printing machine ink roller and a method of the invention for manufacturing the same, a surface layer (18) consisting of a synthetic resin or a rubber-like material, which has ink absorbency and which allows surface polishing, is arranged on a surface of a mandrel, a large number of substantially spherical particles are mixed in the surface layer (18), and a large number of independent projections (16) are formed by partially exposing predetermined substantial particles in a surface region (17) of the surface layer (18). The ink roller can maintain a function of transferring a predetermined amount of ink for a long period of time so that the performance of a printing machine can thus be improved, and such a printing machine can be very easily manufactured and repaired.

4 Claims, 2 Drawing Sheets

FIG. 1 (A)
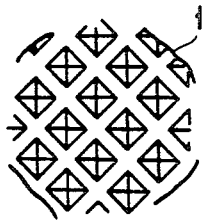
FIG. 2 (A)
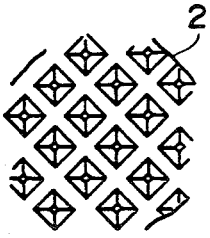
FIG. 1 (B)
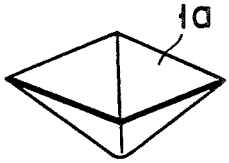
FIG. 2 (B)
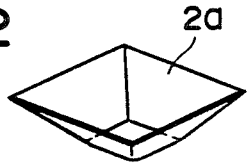
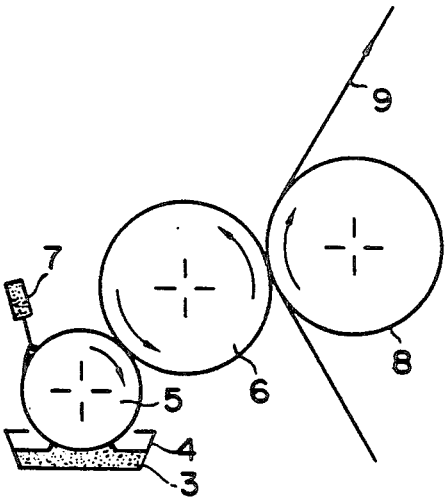
FIG. 3

INK ROLLER FOR PRINTING MACHINE

TECHNICAL FIELD

The present invention relates to an ink roller for a printing machine, which is used as an ink metering roller in an inking unit of a printing machine such as a flexographic printing machine, an offset printing machine, and a relief printing machine, and a method of manufacturing the same.

BACKGROUND ART

A roller called an anilox roller is used as an ink metering roller in an inking unit. The anilox roller has a function of supplying and metering ink. The function is realized by a plurality of independent recesses (cells) 1*a* and 2*a* formed by a laser or mechanical processing on outer surfaces 1 and 2 of the roller composed of a metal or ceramic, as shown in FIGS. 1 and 2.

FIG. 3 shows a schematic arrangement of a flexographic printing machine. Ink 4 in ink pan 3 is transferred onto plate cylinder 6 by anilox roller 5. In this case, excess ink 4 is scraped off by doctor blade 7 in contact with anilox roller 5. Doctor blade 7 is made of steel, a resin, or the like. Only a necessary amount of ink 4 is transferred onto plate cylinder 6 while it is filled in the recesses formed on the outer surface of the anilox roller. An ink film is transferred from plate cylinder 6 to printing material 9 such as paper urged against plate cylinder 6 by the pressure of impression cylinder 8, thereby performing predetermined printing.

FIG. 4 shows a schematic arrangement of a keyless offset printing machine. In this case, ink 4 in ink pans 3 is transferred from fountain rollers 10 to anilox rollers 5. Ink 3 is transferred therefrom to ink forme rollers 11 made of rubber, and then is transferred onto plate cylinders 6. In this case, excess ink 3 is also scraped off by doctor blades 7 brought into contact with anilox rollers 5. Subsequently, ink films are transferred from plate cylinders 6 to rubber blanket cylinders 12 in contact with plate cylinders 6. The ink films are transferred from rubber blanket cylinders 12 to printing material 9 so as to perform predetermined printing.

Dampening water units 13 serve to form non-image area. More specifically, dampening water units 13 supply dampening water 15 using dampening rollers 14 onto the non-image area before ink is supplied to the plate cylinders, thereby preventing adhesion of the ink to nonimage area.

Accordingly, the ink transfer ability of anilox roller 5 having a large number of recesses formed on its outer surface greatly influences printing quality. According to a method of forming recesses on such an anilox roller, for example, a mother mold is urged against the outer surface of a mandrel such that recesses are sequentially formed from one end portion of the mandrel. Then, in order to provide wear resistance to the roller, the outer surface of the mandrel is plated with copper or chromium. According to another method, as described above, a ceramic is flame-sprayed on a mandrel and is grinded, and then recesses are engraved by a laser. Quadrangular pyramid-shaped or quadrangular frustrum pyramid-shaped recesses are often employed. In addition, the number of recesses is set to correspond to the number of lines formed on the outer surface of a mandrel at a rate of, e.g., 165 lines/inch, 180 lines/inch, or 200 lines/inch. The depth of each recess and the amount of ink to be transferred by an anilox roller are decreased with an increase in number of recesses. According to specific requirements of such recesses (cells), (1) high shape precision must be attained, and (2) ink is not easily peeled off by dampening water from anilox roller (in offset printing).

The following drawbacks are posed in a conventional anilox roller.

(1) Anilox rollers having recesses formed by a mother die (1) The shapes of recesses vary widely on a roller or between rollers.

(2) The outer surface of a roller is worn out by a doctor blade, and the shapes of the recesses change upon use of the roller. Consequently, the ink storage amount of the recesses is gradually decreased and the density of a printing matter is changed.

(3) In an arrangement wherein recesses are independent from each other, ink is rejected because of excessive dampening water, i.e., a stripping phenomenon is caused. Note that a normal depth of each recess is 15 to 14 μm.

(2) Anilox rollers having recesses formed by a laser (1) Large-scale facilities are required to form recesses and rollers.

(2) If the outer surface of a roller is damaged, it cannot be repaired. Therefore, a new roller must be manufactured.

(3) Heat is generated between a doctor blade and an anilox roller because of friction. For this reason, a rubber roller in contact with the anilox roller is expanded. As a result, the nip width of the rubber roller must be adjusted.

(4) A stripping phenomenon is caused because of excessive dampening water.

DISCLOSURE OF INVENTION

It is an object of the present invention to provide an ink roller for a printing machine, which can maintain the metering function of a predetermined amount of ink for a long period of time, and improve the printing performance of the printing machine, and which can be very easily manufactured and repaired, and a method of manufacturing the same.

More specifically, according to the presentinvention, an ink roller for a printing machine is characterized by comprising a mandrel, a surface layer consisting of a synthetic resin or a rubber-like material, which is formed on a surface of the mandrel, has ink absorb, and allows surface polishing, a large number of substantially spherical particles mixed in the surface layer, and a large number of independent projections formed by the large number of substantially spherical particles partially exposed on a surface region of the surface layer.

In this case, it is preferable to use any one of urethane, polyamide, epoxy, polyvinyl chloride, polyester, phenolic, urea, polyimide, and polyamide-imide resins as the synthetic resin. In order to adjust ink absorb of the surface layer, two or more of these resins having different ink affinities may be used as needed.

In addition, it is preferable to use any one of nitrile rubber, urethane rubber, chloroprene rubber, acryl rubber, epichlorohydrin rubber, chlorosulfonated polyethylene, chlorinated polyethylene, fluororubber, ethylene propylene rubber, polybutadiene rubber, and natural rubber as the rubber-like material. In order to adjust ink absorb of the surface layer, two or more of these rubbers having different ink affinities may be used.

Each of the synthetic resin and the rubber-like material has slight ink permeability. This ink permeability increases the ink affinity of the surface layer. As a result, a desired ink absorb of the surface layer is realized. Therefore, when the ink roller for the printing machine is used, frequency of occurrence of troubles such as stripping is greatly reduced even if excessive dampening water is supplied, thereby assuring stable printing. Note that when the synthetic resin and rubber-like material of the types described above are observed by a microscope after they are used as a rubber roller for, e.g., one year, ink permeability of about 1 mm is confirmed. Predetermined types of synthetic resins and rubber-like materials should be determined in accordance with the type of ink to be used. It is not preferable to use one having excessive permeability because the external shape of the surface layer is changed.

A copper powder or a copper alloy such as brass or bronze may be mixed in the surface layer to realize a predetermined ink affinity or to adjust it. The hardness of the surface layer is preferably set to be 80 or more in Shore hardness A. This is because the surface layer is greatly worn out by the doctor blade if the hardness is less than 80.

The substantially spherical particles preferably consist of any one or more of silica, alumina ($Al_2O_3$), aluminosilicano, ceramic, glass, stainless steel, epoxy resin, and phenolic resin spherical particles. It is preferable to determine which of these particles is used in consideration of differences in polishing property and affinity with the synthetic resin or the rubber-like material described above. In general, substantially spherical particles of silica or alumina manufactured by high-temperature flame spraying are preferably used.

Each particle is required to have a substantially spherical shape for the following reasons.

It is because the substantially spherical shape can prevent the printing machine ink roller from being damaged by the doctor blade in contact therewith and also prevent abrasion of the doctor blade itself. If alundum or corundum particles of irregular shapes are used instead of spherical particles, the surface of the roller is damaged, and other rollers may be damaged. By using spherical particles, heat generated when the ink roller is brought into contact with other rollers can be suppressed. In addition, if spherical particles are used, excellent flow or fill characteristics can be obtained, thereby facilitating the manufacture of the printing machine ink roller.

The substantially spherical particles are made harder than the synthetic resin and the rubber-like material for the following reasons. With this arrangement, projections can be easily formed to be independent from each other only by grinding surface layer 18, harder particles stay on the roller surface keeping the shape without abrasion, to form exposing projections. As a result, an ink storage section can be formed throughout the even regions between projections 16 and surface layer 18. In addition, by forming hard substantially spherical particles, the shape of the ink storage section can be maintained with high precision for a long period of time, thereby maintaining excellent transfer performance of ink. For this reason, in case of the keyless offset printing machine shown in FIG. 4, this printing machine ink roller is used instead of anilox roller 5. In this case, ink 4 in an ink storage section (corresponding to the portion denoted by reference numeral 17 in FIG. 5) of ink roller for printing machine's surface 18 is transferred onto forme roller 11. Transfer of ink 4 is performed at a position where the nips of ink roller for printing machine's surface 5 and forme roller 11 are separated from each other. Since ink 4 in ink storage section 17 is continuous, a so-called vacuum effect caused in conventional anilox roller 1*a*, 1*b* shown in FIG. 1, FIG. 2 can be prevented. As a result, transfer of ink 4 can be extremely effectively and easily performed. In addition, the present invention is advantageous in that even when the surface of a roller is accidentally damaged or worn out, a new surface layer having a large number of independent projections can be formed by simply polishing the surface of the roller again using a whetstone or the like.

Each of the substantially spherical particles is preferably formed into a spherical shape within the range of 5 to 100 $\mu$m, more preferably the range of 10 to 60 $\mu$m when the thickness of an ink film required for ink transfer is taken into consideration.

The thickness of an ink film or the density of ink in printing using this printing machine ink roller is determined by setting the amount and size of the substantially spherical particle to be predetermined values, respectively. For example, when the density of ink is decreased by thinning an ink film, small substantially spherical particles are used to reduce the gap between the doctor blade in contact with the printing machine ink roller. In contrast to this, when the density of ink is increased by thickening an ink film, large substantially spherical particles are used to increase the gap between the printing machine ink roller and the doctor blade.

Furthermore, according to the present invention, there is provided a method of manufacturing a printing machine ink roller, in which a surface layer having a large number of recesses and projections formed in a surface region is formed on an outer surface of a mandrel, characterized in that a surface layer is formed by the steps of mixing a matrix consisting of a synthetic resin or a rubber-like material having ink absorbency with a large number of substantially spherical particles having a hardness higher than that of the matrix, forming the matrix and the substantially spherical particles integrally with each other by curing or crosslinking the mixture obtained in the preceding step so as to form a surface layer material, and partially exposing arbitrary particles of the large number of substantially spherical particles by polishing the surface layer material so as to form a large number of independent projections.

A cast molding method, a rotational molding method, a sheet winding method, a reaction injection molding (RIM) method, or a flame spraying method can be used as a means for causing the surface layer to be adhered to the mandrel.

The cast molding method can be used when the matrix has a liquid form. In this method, a matrix, substantially spherical particles, and a curing agent are mixed, and then the resultant mixture is degassed to form a mixture for forming a surface layer. Subsequently, a mandrel having an adhesive coated on its surface is set in a mold. The mixture is poured into the mold and cured to form a surface layer integrated with the mandrel. After this, the surface layer is polished to form a printing machine ink roller.

In the rotational molding method, a cylindrical mold for rotational molding is prepared. Then, the inner surface of a cavity portion of the mold is polished and a mold lubricant is coated on the inner surface. A mixture obtained in the same manner as that in the cast molding method is poured into the cavity. The mixture is subjected to rotational molding at a predetermined temperature for a predetermined period of time and is cured to form a portion corresponding to a surface layer. The resultant surface layer is released from the mold and its inner surface is grinded. Then, a predetermined mandrel is fitted into the surface layer by, e.g., shrink fitting. The surface layer is polished to form a printing machine ink roller.

The sheet winding method can be used when a matrix has a solid form and is of a kneading type. In this method, substantially spherical particles, a crosslinking agent, and other necessary chemicals such as a processing aid are mixed with the matrix using milling rolls to form a sheet. Then, the sheet is wound around a predetermined mandrel. The wound sheet is subjected to a heat treatment to form a surface layer integrated with the mandrel. Subsequently, the surface layer is subjected to a polishing treatment to obtain a printing machine ink roller. In this case, the surface layer to be wound around the mandrel may be formed by extrusion molding.

In these method, polishing is performed by a whetstone or an abrasive cloth.

In addition, the types of a synthetic resin, a rubber-like material, and the substantially spherical particles, and the shape of the substantially spherical particle are the same as those in the above-described methods.

The content of the substantially spherical particles to be mixed with the matrix is 10 to 400 parts by weight with respect to 100 parts by weight of the matrix. If the content is less than 10 parts by weight, a level difference for forming an ink storage section becomes insufficient. If the content exceeds 400 parts by weight, the number of projections becomes too large, thereby degrading ink retaining performance.

Moreover, a copper powder or a copper alloy such as brass or bronze may be mixed with the matrix as needed. In this case, the amount of copper powder to be mixed with the matrix is preferably 50 to 400 parts by weight with respect to 100 parts by weight of the matrix.

BRIEF DESCRIPTION OF THE DRAWINGS

FIGS. 1(A)-(B) and 2(A)-(B) are views illustrating recesses formed in the outer surfaces of anilox rollers;

FIG. 3 is a view illustrating a schematic arrangement of a flexographic printing machine;

THE BEST MODE FOR CARRYING OUT THE INVENTION

An embodiment of the present invention will be described below.

EXAMPLE 1

100 parts by weight of Sannix HR-450P (polyol available from SANYO CHEMICAL INDUSTRIES, LTD.) were heated/dehydrated, and 150 parts by weight of hard spherical particles S-COL (available from MICRON Co., Ltd.) consisting of silica having an average grain size of 25 μm were mixed therewith. Then, 110 parts by weight of Millionate MT (isocyanate available from Nihon Polyurethane Co., Ltd.) were added to the resultant mixture, and the mixture was agitated at a reduced pressure to obtain a material for forming a surface layer.

After having treated a mandrel so as to remove any rust or grease therefrom, an adhesive was coated on the mandrel and the mandrel was then placed in a mold. Then, the material obtained in the above-described manner was poured into this mold and heated at 85° C. for six hours to be cured, thereby forming a surface layer on the surface of the mandrel. Subsequently, the molded product was released from the mold and sufficiently cooled, and the surface layer was surface-polished using a whetstone to form a surface layer having an outer diameter of 175 mm and a thickness of 5 mm.

Figure 4:
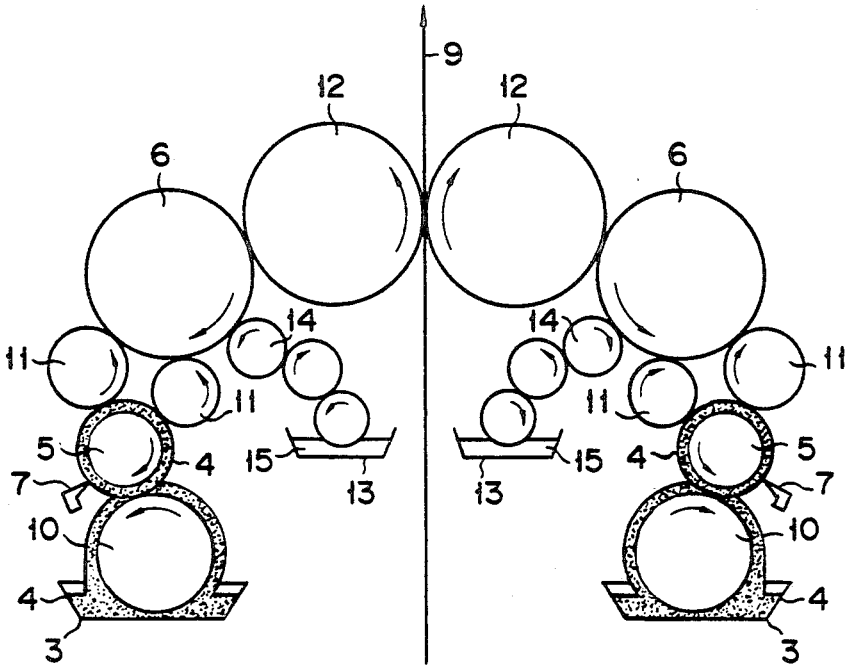
FIG. 4 is a view illustrating a schematic arrangement of a keyless offset printing machine.
Figure 5:
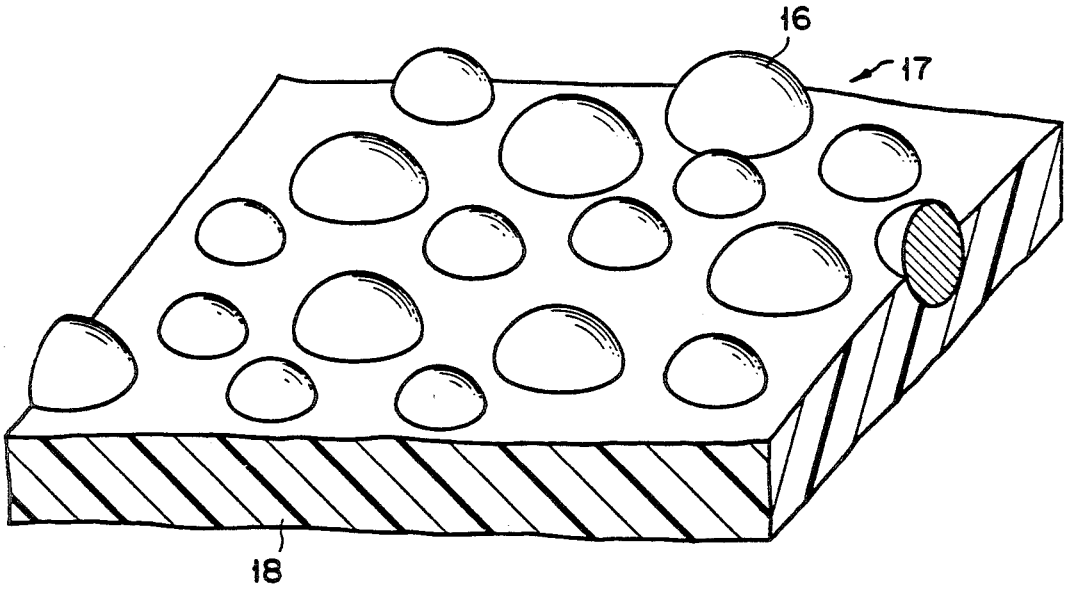
FIG. 5 is a perspective view showing a surface layer of a ink roller according to an embodiment of the present invention.

A printing machine ink roller obtained in this manner had a surface roughness (Rz) of 5 to 7 μm and a Shore D hardness of 87. This printing machine ink roller was mounted on the same printing machine as shown in FIG. 4 as anilox roller 5, and printing was performed at 300 rpm for six hours. In this case, since no variation in ink density occurred, an excellent printed matter can be said to have been obtained. When the solid density of this printed matter was measured by a GRETAG densitometer D142-3, a density of 0.9 was recorded.

EXAMPLE 2

100 parts by weight of anhydrous ε-caprolactam were heated to 80° C., and then 0.5 mol % of metal potassium was added and mixed therewith. 30 parts by weight of hard spherical particles CB-A40 (available from Showa Denko Co., Ltd.) consisting of alumina having an average grain size of 42 μm were mixed with the resultant mixture. Subsequently, 0.5 mol % of tolylene diisocyanate was added to this mixture and heated to 120° C. to obtain a material for forming a surface layer.

This material was poured in a mold for rotational molding and was rotated at 750 rpm at 145° C. to be cured, thereby forming a surface layer having an outer diameter of 176 mm. Then, an iron core was shrink-fitted in this surface layer. The surface layer was polished by a whetstone to form a surface layer having an outer diameter of 175 mm and a thickness of 5 mm.

A printing machine ink roller obtained in this manner had a surface roughness (Rz) of 10 to 15 μm and a Shore D hardness of 80. This printing machine ink roller was mounted onto a keyless offset printing machine as an ink metering roller, and printing was performed at 300 rpm for five hours. In this case, since no variation in ink density occurred, an excellent printed matter can be said to have been obtained. When the solid density of this printed material was measured by a GRETAG densitometer D142-3, a density of 1.05 was recorded.

EXAMPLE 3

10 parts by weight of HY956 (available from Nihon Chiba Gaigy Co., Ltd.) serving as a curing agent were mixed with 100 parts by weight of epoxy resin Araldite AY101 (available from Nihon Chiba Gaigy Co., Ltd.). Then, 200 parts by weight of hard spherical particles of Alunabeads CB-A50 (available from Showa Denko Co., Ltd.) consisting of alumina having an average grain size of 50 μm were mixed with the resultant mixture. This mixture was agitated and degassed to obtain a material for forming a surface layer.

After derusting and degreasing treatments, an adhesive was coated on a mandrel and the mandrel was set in a mold. The material obtained in the above-described manner was poured in the mold and was left to stand in a room, in which a temperature was controlled to be about 40° C., for 24 hours to be cured, thereby forming a surface layer on the surface of the mandrel. After this was released from the mold, the surface layer was polished by a whetstone to obtain a printing machine ink roller having an outer diameter of 175 mm and a thickness of 5 mm.

The printing machine ink roller obtained in this manner had a surface roughness (Rz) of 13 to 15 μm, and a Shore D hardness of 85. This printing machine ink roller was mounted on a keyless offset printing machine, and continuous printing was performed at 300 rpm for eight hours per day for six months. In this case, a uniform printed matter was obtained without causing stripping. When the solid density of this printed matter was measured by a GRETAG densitometer D142-3, 1.1 was recorded.

EXAMPLE 4

100 parts by weight of a copper powder Cu-At-W-250 (available from Fukuda Kinzokuhakufun Co., Ltd.) and 180 parts by weight of hard spherical particles of Alunabeads CB-A60 (Showa Denko Co., Ltd.) consisting of alumina having an average grain size of 60 μm were mixed with 100 parts by weight of PolybdR45HD (polybutadiene available from Idemitsu Sekiyu Kagaku Co., Ltd.). This mixture was agitated and degassed. Then, 15 parts by weight of Isonate 143L (available from Kasei Upjohn Co., Ltd.) serving as a curing agent and 0.01 parts by weight of catalytic dibutyl tin dilaurate were added to the mixture and were sufficiently mixed together to obtain a material for forming a surface layer.

After derusting and degreasing treatments, an adhesive was coated on a mandrel and the mandrel was set in a mold. This material was poured in the mold and was left to stand at room temperature for three days to be cured, the surface layer was polished by a whetstone, thereby forming a surface layer having an outer diameter of 175 mm and a thickness of 5 mm.

A printing machine roller obtained in this manner had a surface roughness (Rz) of 15 to 17 μm and a Shore A hardness of 80. This printing machine ink roller was mounted on a flexographic printing machine, and printing was performed at a speed of 100 m/min. In this case, no variation in printing was found. When the solid density was measured by a GRETAG densitometer D142-3, 1.2 was recorded.

EXAMPLE 5

| Composition | Parts by weight |
|---|---|
| JSRN230 (nitrile rubber available from Nihon Goseigomu Co., Ltd.) | 100 |
| zinc oxide | 5 |
| sulfur | 40 |
| accelerator D | 2 |
| stearic acid | 1 |
| clay | 50 |
| Sumilight resin PR310 B (a phenolic resin available from Sumitomo Jurettsu Co., Ltd.) | 30 |
| Nipole (liquid nitrile rubber available from Nihon Zeon Co., Ltd.) | 10 |
| Alunabeads CB-A30 (hard spherical alunabeads having an average grain size of 30 μm available | 150 |

-continued

| Composition | Parts by weight |
|---|---|
| from Showa Denko Co., Ltd.) | |

The above-described composition was sufficiently kneaded by milling roll. Then, the resultant composition was formed into a sheet having a thickness of about 2 mm using calender roll. A separately mandrel was sandblasted. Subsequently, rubber cement prepared by dissolving the composition into toluol was coated on the surface of the mandrel. The sheet prepared in the above-described manner was wound around the mandrel coated with the rubber cement until the thickness of sheet became about 8 mm. A cotton tape and a steel wire were wound around the outer surface of the surface layer formed upon winding of the sheet. In this state, the resultant product was introduced into a vulcanizer and heated at a water vapor pressure of 4 kg/cm$^2$ for eight hours. The surface layer vulcanized in this manner was polished by a whetstone and 360-mesh sandpaper.

A surface layer having an outer diameter of 175 mm and a thickness of 5 mm was formed in this manner. This surface layer had a Shore D hardness of 90 and a surface roughness (Rz) of 7 to 9 μm.

A printing machine ink roller obtained in this manner was mounted on a keyless relief printing machine, and printing was performed at 3,00 rpm for four hours. No problem was posed in printing. When the solid density of a printed matter was measured by a GRETAG densitometer D142-3, 0.95 was recorded.

INDUSTRIAL APPLICAPABILITY

The roller of the present invention can maintain a function of transferring a predetermined amount of ink for a long period of time and can improve the printing performance of a printing machine, can be very easily manufactured and repaired, and can be effectively used as an ink transfer roller in printing machines such as flexographic, offset, and relief printing machines.

We claim:

1. An ink metering roller for use in a printing machine comprising a mandrel, an exterior surface layer formed on said mandrel consisting of an ink absorbent matrix material of synthetic resin or rubber and having substantially spherical particles mixed therein, said particles arranged to form independent, partially exposed projections on a surface region of said surface layer, said particles selected from the group consisting of silica, alumina, aluminosilicano, ceramic, glass, stainless steel, epoxy resin, and phenolic resin spherical particles; wherein each of said substantially spherical particles has a grain size of from about 5 to 100 μm; and wherein said substantially spherical particles are embedded in said surface layer to a depth of at least 2.5 μm from said surface region.

2. An ink metering roller according to claim 1 wherein said substantially spherical particles have a hardness greater than said matrix material, so that said matrix material can be ground from said substantially spherical particles to thereby form said independent, partially exposed projections.

3. An ink metering roller according to claim 2 wherein said substantially spherical particles comprise 10 to 400 parts by weight to 100 parts by weight of said matrix material.

4. An ink metering roller according to claim 3 having a surface roughness (Rz) of from about 5 to 17 μm and a Shore D hardness of from about 80 to 87.

* * * * *